US007971721B1

(12) United States Patent
McMillan

(10) Patent No.: US 7,971,721 B1
(45) Date of Patent: Jul. 5, 2011

(54) DECORATIVE CHRISTMAS GIFT WRAP KIT AND METHOD

(76) Inventor: Robbie Ann McMillan, Carrollton, GA (US)

( * ) Notice: Subject to any disclaimer, the term of this patent is extended or adjusted under 35 U.S.C. 154(b) by 337 days.

(21) Appl. No.: 11/839,637

(22) Filed: Aug. 16, 2007

(51) Int. Cl.
*B65D 71/00* (2006.01)
*B65D 73/00* (2006.01)
*B65D 25/34* (2006.01)

(52) U.S. Cl. ..... 206/575; 206/232; 206/457; 229/116.4

(58) Field of Classification Search ..... 206/457, 206/458, 575, 579, 232; 229/116.4; 446/75–79, 446/102–116; 40/594
See application file for complete search history.

(56) References Cited

U.S. PATENT DOCUMENTS 1,623,545 A * 4/1927 Loewenbach ..... 446/79
1,742,905 A * 1/1930 Friedel ..... 446/109
2,651,131 A 9/1953 Long et al.
3,116,096 A 12/1963 Kavanagh
3,614,840 A * 10/1971 Vadell ..... 446/82
4,101,032 A 7/1978 Obidniak
4,131,227 A * 12/1978 Patton et al. ..... 229/116.4
4,253,267 A * 3/1981 Kocolowski ..... 446/105
4,784,314 A 11/1988 Penick
4,807,755 A 2/1989 Jones
4,987,019 A 1/1991 Jones
5,001,853 A 3/1991 Odien
5,007,229 A 4/1991 Weder et al.
5,100,002 A 3/1992 Garran
5,251,759 A * 10/1993 Gannon et al. ..... 206/575
5,269,691 A * 12/1993 Waldman ..... 40/594
6,299,060 B1 * 10/2001 Garran ..... 229/116.4
6,581,822 B1 6/2003 Garran
6,905,338 B1 * 6/2005 Garran ..... 229/116.4
6,997,322 B2 * 2/2006 Peterson ..... 206/457
2002/0150700 A1 10/2002 Tennie
2003/0089083 A1 5/2003 Phillips
2004/0129582 A1 7/2004 Cutler
2004/0195134 A1 10/2004 Li
2005/0183979 A1 8/2005 Wilson et al.
2007/0034545 A1 * 2/2007 Sabalaskey et al. ..... 206/575

* cited by examiner

*Primary Examiner* — Bryon P Gehman
(74) *Attorney, Agent, or Firm* — Christine Q. McLeod; Beusse Wolter Sanks Mora & Maire, PA

(57) ABSTRACT

A decorative gift-wrap kit for creating a background scene of a village for a Nativity set by wrapping presents to simulate a plurality of background buildings adapted to be arranged as the background scene for the Nativity set. The kit includes wrapping paper for a plurality of presents designed to visually represent the exterior of buildings; a plurality adhesive stickers on a backing sheet shaped as windows, doors, and archways; and instructions with suggested arrangement displays.

18 Claims, 3 Drawing Sheets

DECORATIVE CHRISTMAS GIFT WRAP KIT AND METHOD

BACKGROUND OF THE INVENTION

1. Technical Field

This invention relates generally to gift packaging, and more particularly to a decorative gift-wrap kit for gift packaging, which turns the wrapped presents into a nativity background scene/skyline.

2. Background Art

The Nativity of Jesus, or simply the Nativity, is the story of the birth of Jesus of Nazareth in Bethlehem. The remembrance, representation and re-enactment of the Nativity scene are at the heart of the Christian celebration of Christmas. Christian nativity scenes usually show Jesus in a manger, Joseph and Mary in a barn (or cave) intended to accommodate farm animals. At Christmas time these arrangements are created and displayed in Catholic and Protestant homes, churches, businesses, retailers and other public locations, under the Christmas tree, on a table, or the like.

Along with the Nativity scene, those that celebrate Christmas also wrap numerous presents and place them under the tree or on tables or the like. Christmas wrapping papers, gift bags, and gift boxes are often brightly colored with solid or patterned designs having ribbons, bows, and the like. These Christmas presents noticeably detract from the significance of the Nativity scene.

Therefore, there is a need in the art for a way to incorporate Christmas presents with the Nativity scene providing an opportunity to share/teach and preserve the significance of the Nativity scene without detracting there from.

SUMMARY OF THE INVENTION

The present invention addresses those needs by providing a decorative gift-wrap kit for gift packaging, which turns the wrapped presents into a nativity background scene/skyline, while providing a favorable time to share/teach the virtues of the Nativity.

In an embodiment, the invention comprises a decorative gift-wrap kit for wrapping presents to simulate a plurality of buildings/structures that may be arranged as a background scene, comprising: (a) wrapping material designed to visually represent an exterior building surface for creating a wrapped present; and (b) a plurality of adhesive stickers removably adhered to a backing sheet, said stickers having an adhesive side and a outer side, said outer side visually representing building/structure features so that when applied to the wrapped present, the wrapped present simulates a building/structure that may be arranged as a background/skyline scene. The decorative gift-wrap kit may further include a set of instructions or the adhesive stickers may be pre-arranged on the backing sheet in a suggested display.

The wrapping material may include wrapping paper, a gift-bag, a gift-box, or a pre-wrapped gift-box. The wrapping can include colored paper, patterned paper, textured paper, illumination paper or a combination thereof. The wrapping material may visually resemble stone or mud.

The building features on the stickers comprise one or more of windows, doors, doorways, stairways, archways, and window openings. Additional stickers representing one or more of people, animals, plant life, pottery, carts, and scenery items may be provided.

A corresponding Nativity sticker book wherein the adhesive stickers are removably adhered to pages of the Nativity book may be included.

The invention also includes a method for creating a background for a Nativity scene comprising: (a) wrapping a plurality of presents with wrapping material for creating wrapped presents, wherein the wrapping material is suitably colored, patterned, or textured to visually represent an exterior building surface; (b) applying a plurality of adhesive stickers to the wrapped presents, said stickers having an adhesive side and a outer side, said outer side visually representing building features comprising one or more of windows, doors, doorways, stairways, archways, and window openings so that the wrapped presents simulate buildings/structures; and (c) arranging the wrapped presents as a background scene for the Nativity.

All patents, patent applications, provisional applications, and publications referred to or cited herein, or from which a claim for benefit of priority has been made, are incorporated herein by reference in their entirety to the extent they are not inconsistent with the explicit teachings of this specification.

BRIEF DESCRIPTION OF THE DRAWINGS

Further objects, features and advantages of the invention will become apparent from the following detailed description taken in conjunction with the accompanying figures showing a preferred embodiment of the invention, in which.

Figure 1:
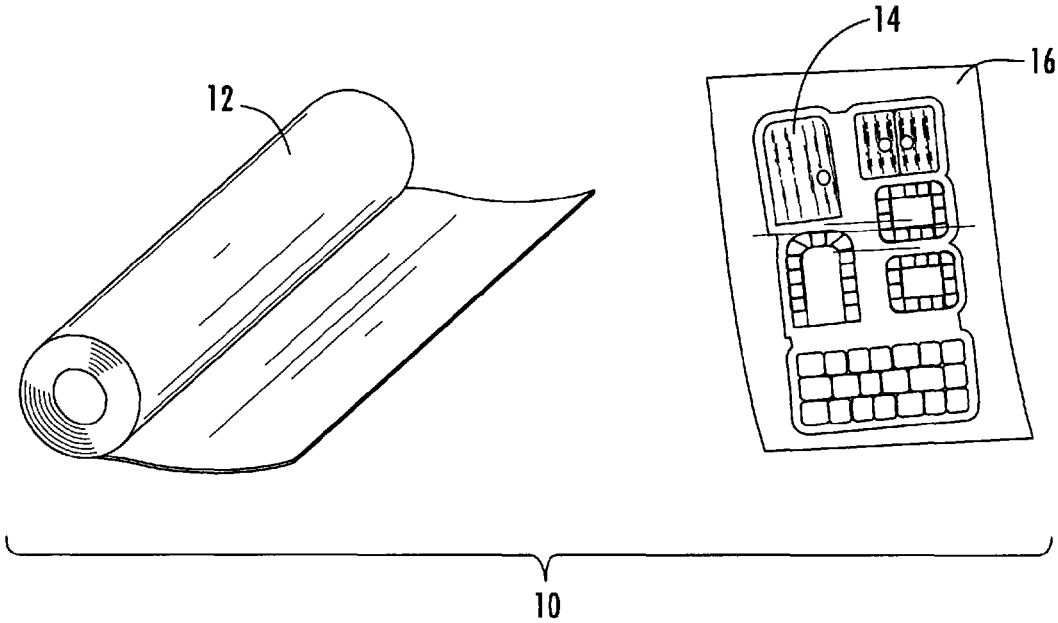
FIG. 1 is a schematic representation of a decorative gift-wrap kit in accordance with an embodiment of the present invention.

Throughout the figures, the same reference numerals and characters, unless otherwise stated, are used to denote like features, elements, components or portions of the illustrated embodiment. Moreover, while the subject invention will now be described in detail with reference to the figures, it is done so in connection with a preferred embodiment. It is intended that changes and modifications can be made to the described embodiment without departing from the true scope and spirit of the subject invention.

DETAILED DESCRIPTION OF THE PREFERRED EMBODIMENT

FIG. 1 is a schematic representation of a decorative gift-wrap kit 10 in accordance with an embodiment of the present invention. In general, the decorative gift-wrap kit 10 includes wrapping paper 12 and a plurality of adhesive stickers 14 for adhering to the wrapping paper 12. The adhesive stickers 14 are removably adhered to at least one backing sheet 16 which may be coupled to wrapping paper 12 or otherwise provided in the kit.

The wrapping paper 12 is preferably brown, beige or other earth tone, mud, or stone color to represent the materials from which buildings (e.g., homes, temples, shops, walls, and other background/skyline structures) were made in Bethlehem village at the time of the birth of Jesus. Faux patterns simulating mud/stone/brick may also be provided. The wrapping paper may be of paper or other suitable stock (including cardboard, plastic, and vinyl) and can include a texture. For example, faux stone pattern may also include a stone-like texture to make it appear more authentic. The wrapping paper 12 is used to wrap presents of various shapes and sizes (hereinafter "wrapped presents" 20).

Figure 2:
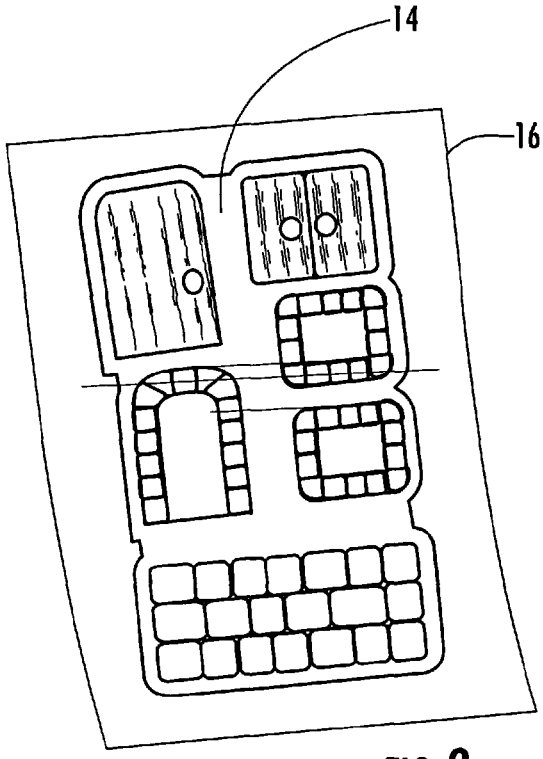
FIG. 2 is a schematic representation of a set of adhesive stickers of a decorative gift-wrap kit in accordance with an embodiment of the present invention.
Figure 3:
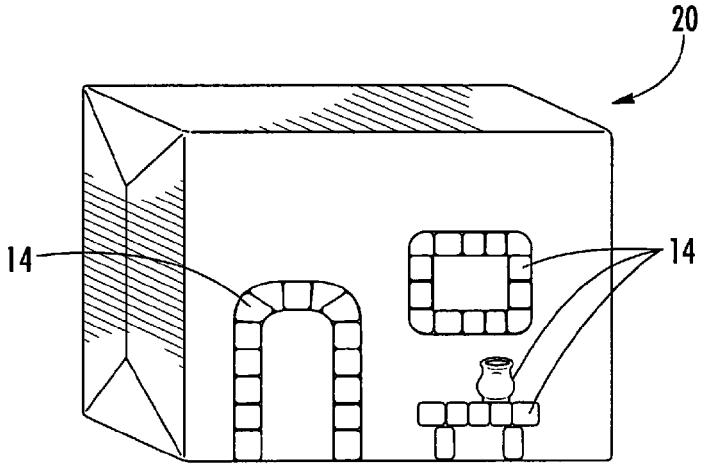
FIG. 3 is a schematic representation depicting a wrapped present in accordance with an embodiment of the present invention.

Turning now to FIG. 2, the adhesive stickers 14 preferably include representations of windows, doors, doorways, stairways, archways, or other building features that will be adhered to the wrapping paper 12 on the wrapped presents 20 so that the wrapped presents 20 represent an elevation view to look like homes, temples, shops, walls, and other background/skyline structures in Bethlehem when placed behind and around a Nativity scene 22 (See FIGS. 3-6). Additionally, adhesive stickers 14 representing people, animals, pottery, carts, and other scenery may also be provided. The adhesive stickers may comprise paper, plastic or other suitable material and may include a texture or illumination layer on the outer face (opposite the adhesive face). Blank stickers or a sheet of adhesive material may also be provided for a user to create their own design/pattern.

The adhesive stickers 14 may utilize permanent and/or removable/re-adhereable adhesive. Removable/re-adhereable adhesive would allow the stickers 14 to be repositioned and also removed and saved for next year.

The adhesive stickers 14 each have an adhesive face removably and adhesively coupled to the backing sheet. The adhesive back face of each sticker has an adhesive thereon for adhesively coupling the sticker to the wrapping paper, gift bag and/or gift box. The stickers may each have a decorative outer face representing windows, doors, doorways, stairways, or other building features, people, animals, pottery, carts, and other scenery.

Suitable instructions and/or sample layout patterns for the stickers 14 may also be provided either as a separate sheet, on the reverse side of the wrapping paper 12, or the reverse side of the backing sheet 16. Alternately, the adhesive stickers 14 may be pre-arranged on the backing sheet 16 to represent a typical or suggested display. The adhesive stickers 14 may be part of a Nativity story sticker book and can be used for the book and the wrapped presents.

Figure 5:
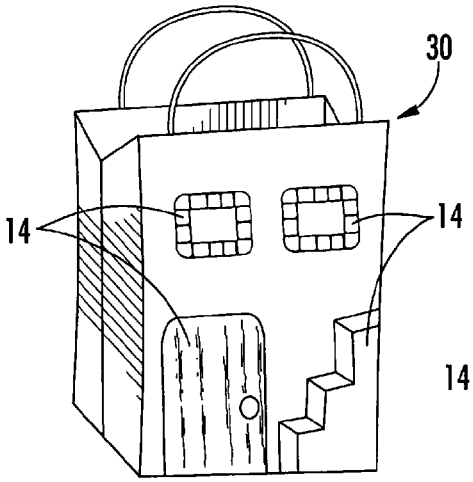
FIG. 5 is a schematic representation depicting a gift bag in accordance with an embodiment of the present invention.

In an alternate embodiment, FIG. 5, a gift bag 30 is provided, wherein the gift bag is square, rectangular, and/or shaped so that it may resemble a building/structure or skyline. The gift bag 30 has a bottom, a plurality of sides upwardly extending around the bottom of the bag, and an upper edge defining an upper opening into the bag 30, as known in the art. The gift bag 30 is preferably brown, beige or other earth tone or stone color to represent the materials from which buildings (e.g., homes, temples, shops, walls, and other background/skyline structures) were made in Bethlehem village. Faux patterns simulating stone/brick may also be provided. The gift bag 30 may be of paper or other suitable stock and can include a texture. For example, faux stone pattern may also include a stone-like texture to make it appear more authentic. The gift bag 30 is used to hold presents of various shapes and sizes (also referred to herein as "wrapped presents" 20). The adhesive stickers 14 may then be applied as previously described.

Figure 6:
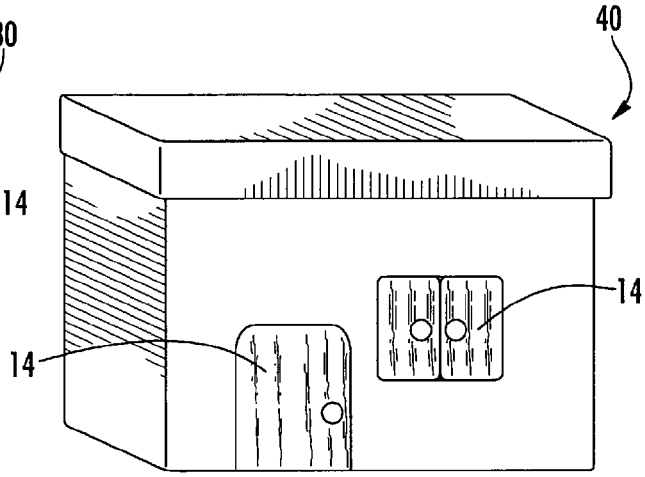
FIG. 6 is a schematic representation depicting a gift box in accordance with an embodiment of the present invention.
Figure 4:
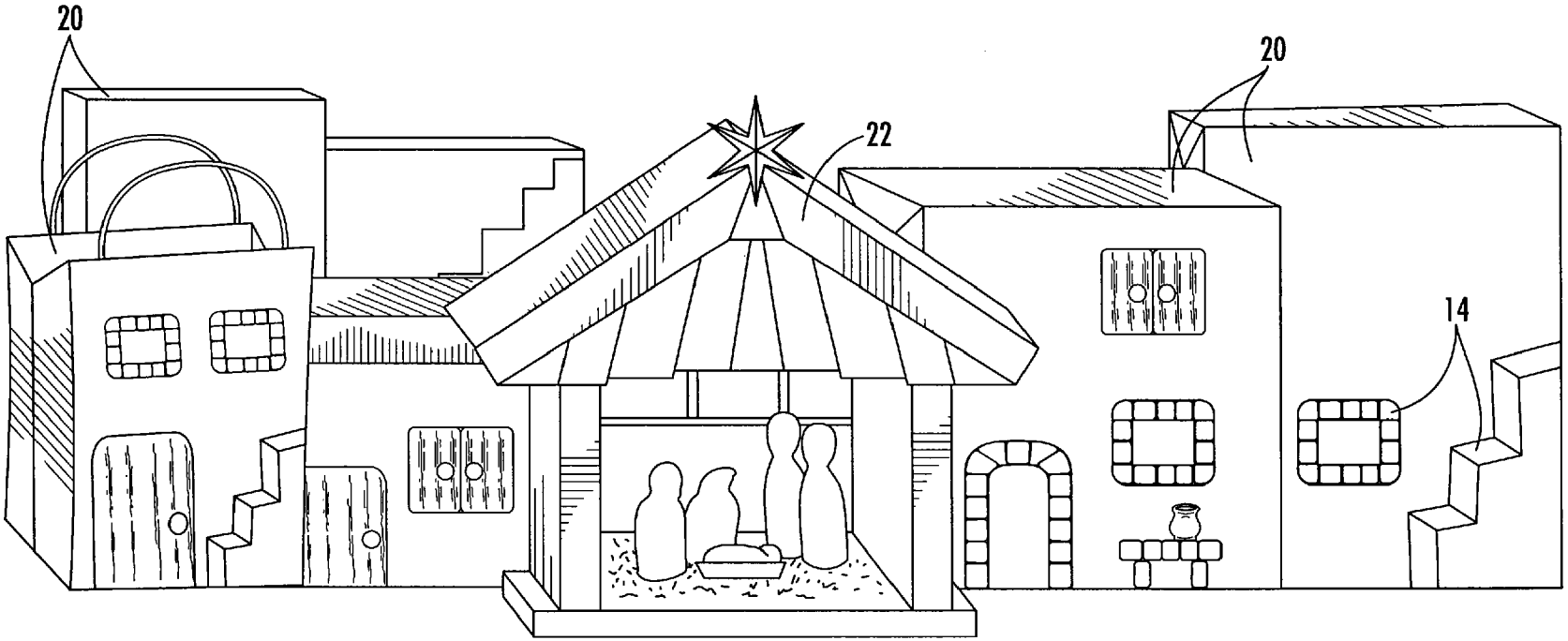
FIG. 4 is a schematic representation depicting wrapped presents made with the gift-wrap kit positioned as the nativity background scene/skyline in accordance with an embodiment of the present invention.

In an alternate embodiment, FIG. 6, a gift box 40 is provided, wherein the gift box is square, rectangular, and/or shaped so that it may resemble a building/structure or skyline. The gift box 40 has a bottom, a plurality of sides upwardly extending around the bottom of the box, and a top, as is known in the art. The gift box 40 is preferably brown, beige or other earth tone or stone color to represent the materials from which buildings (e.g., homes, temples, shops, walls, and other background/skyline structures) were made in Bethlehem village. Faux patterns simulating stone/brick may also be provided. The gift box 40 may be of cardboard or other suitable stock and can include a texture. For example, faux stone pattern may also include a stone-like texture to make it appear more authentic. The gift box 40 is used to hold presents of various shapes and sizes (also referred to herein as "wrapped presents" 20). Alternately, the gift box 40 is pre-wrapped with the wrapping paper 12 described above or sold as a kit with the wrapping paper described above. The adhesive stickers 14 may then be applied as previously described.

The adhesive stickers 14 may be initially mounted to the backing sheet(s) 16. After wrapping the presents with the wrapping paper 12, or placing them in gift bags 30 or gift boxes 40 (i.e., "wrapped presents" 20), next, one or more of the stickers 14 may be removed from their associated backing sheet 16 and adhered to the wrapped presents 20 to decorate the wrapped presents 20 to look like the background/skyline for the Nativity scene. The stickers 14 may be adhered to the side of the wrapped present 20 that will face forward, however, it should be understood that the stickers may be adhered to any portion of the wrapped present 20 that a user so desires.

In an alternate embodiment, alphanumeric stickers 14 may be included and adhered to wrapped presents 20 so that the stickers are arranged on the wrapped presents 20 to form or spell out a person's name, for example, to know who gave the present and who is to receive the present.

In an alternate embodiment, one or more stencils may be included rather than or in addition to the adhesive stickers. The stencils would include patterns for windows, doors, archways, etc. used to create the look of buildings, etc. on the wrapped presents 20. The kit may further include the writing utensil such as crayons, colored pencils, or the like.

With embodiments of the decorative gift-wrap kit 10 set forth herein, a user may be afforded the ability to create a background/skyline for their Nativity scene with their presents.

In one embodiment, the decorative gift-wrap kit 10 may include the following items (in suitable quantities):

(1) wrapping paper in one or more rolls, sheets, or the like (and/or gift boxes and/or gift bags in various dimensions/styles, including those specifically shaped to look like particular structures);

(2) a plurality adhesive stickers on a backing sheet; and (3) instructions with suggested arrangement displays.

The kit may further include one or more of a Nativity scene, additional props (e.g., palm trees, a star, characters, etc.), a book/booklet describing the Nativity story, an audio and/or video Nativity story.

A corresponding Nativity sticker story book may include the set of adhesive stickers as one or more pages of the book and the stickers may be used for the wrapped presents and/or removably adhered to the pages of the book as known in the art of sticker books. The sticker book may further provide suggested arrangements for the stickers on the wrapped presents and suggested placements for the wrapped presents that simulate buildings/structures around the Nativity.

A sample kit could include four rolls of brown wrapping paper 30"×15' each; sixty assorted stickers in varying shapes and size of windows; twenty assorted stickers in varying shapes and size of doors; and simple instructions. Separately available accessories could include one star, two palm trees, and one Nativity scene, a book/booklet and or video describing the Nativity story.

In one embodiment, the choice of contents for the kit may be made by a user at a point of sale from a selection of wrapping paper, gift bags, gift boxes, and adhesive stickers displayed at the point of sale. This way, a user may be able to customize the contents of the kit 10 to suit their own individual needs and style.

In another embodiment, the kit may be provided with a brown paper bag (e.g., grocery bag) for shoppers. For example, the kit would include with the brown paper bag used for shopping items/groceries, a sheet of stickers (including, for example, four windows and one door), and simple instructions in accordance with the invention described above. The sheet of stickers (with optional instructions/suggested layout) could be inserted into the bag or removably adhered to the bag during holiday season for customers to use the bag as gift-wrap when they get home. If the store includes printing on the bag, the bag may be turned inside out prior to using it as wrapping paper. Alternately, a stencil that represents doors, windows, etc. may be provided rather than adhesive stickers and may include a writing utensil such as crayons, colored pencils, etc.

Rather than the Nativity/Christmas celebration, the stickers may be themed for Hanukah or other similar celebrations/situations where presents are to be wrapped and made to look like a background scene/skyline. In cities, like New York, where the skyline is well-known, the presents can be made to look like the New York skyline, for a more modernized celebration.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

The invention claimed is:

1. A decorative gift-wrap kit comprising components for creating an elevation view of a background scene of a skyline of a Bethlehem village for placing behind a separate Nativity set, the elevation view created from a plurality of presents wrapped with the components of the kit to simulate a plurality of background buildings adapted to be arranged as a background scene behind the separate Nativity set such that the plurality of wrapped presents does not resemble Christmas presents, comprising:

(a) wrapping material in sheet form provided in one or more rolls or sheets for wrapping around a plurality of presents such that the size and shape of the presents to be wrapped, rather than the size and shape of the wrapping material, govern the size and shape of the wrapped presents that ultimately are arranged as buildings of different shapes and sizes, wherein the wrapping material includes an adornment that visually represents the appearance of an exterior building material surface without any building features, the wrapping material for creating a plurality of wrapped presents of different shapes and sizes, wherein the plurality of wrapped presents of different shapes and sizes are adapted to be arranged together as different shaped and sized buildings based on the size and shape of the presents to form a background scene of a skyline of a Bethlehem village when placed behind a separate Nativity set, wherein the Nativity set comprises a manger in a barn for the Christian re-enactment of the birth of Jesus;

(b) a plurality of adhesive stickers removably adhered to a backing sheet, said stickers having an adhesive side and an outer side, said outer side visually representing building features, wherein said building features consist of at least one of windows, doors, doorways, stairways, archways, and window openings, so that when applied to the plurality of wrapped presents, the adhesive stickers realistically enhance the background scene of the skyline of the Bethlehem village when placed behind the separate Nativity set; and (c) a set of instructions that suggest arrangement displays thereon to direct a user to arrange the plurality of wrapped presents as the background scene of the skyline of the Bethlehem village and place them behind the separate Nativity set, wherein the plurality of wrapped presents together resemble the skyline of the Bethlehem village and do not resemble Christmas presents that would detract from the separate Nativity set.

2. The decorative gift-wrap kit of claim 1 wherein the plurality of adhesive stickers removably adhered to a backing sheet are pre-arranged in a suggested display.

3. The decorative gift-wrap kit of claim 1 wherein the wrapping material is wrapping paper.

4. The decorative gift-wrap kit of claim 1 further comprising one or more gift-bags, wherein the gift-bags are adorned with one or more of colors, patterns, or textures to visually represent exterior building surfaces for receiving presents in the gift-bags creating plurality of bagged presents, wherein the plurality of bagged presents are adapted to be arranged together with the plurality of wrapped presents in the background scene.

5. The decorative gift-wrap kit of claim 1 further comprising one or more gift-boxes, wherein the gift-boxes are adorned with one or more of colors, patterns, or textures to visually represent exterior building surfaces for receiving presents in the gift-boxes creating a plurality of presents in gift-boxes, wherein the plurality of presents in gift-boxes are adapted to be arranged together with the plurality of wrapped presents in the background scene.

6. The decorative gift-wrap kit of claim 1 further comprising one or more pre-wrapped gift-boxes, wherein the pre-wrapped gift-boxes are adorned with one or more of colors, patterns, or textures to visually represent exterior building surfaces for receiving presents in the pre-wrapped gift-boxes creating plurality of pre-wrapped gift-boxed presents, wherein the plurality of pre-wrapped gift-boxed presents are adapted to be arranged together with the plurality of wrapped presents in the background scene.

7. The decorative gift-wrap kit of claim 1 wherein the wrapping material comprises colored paper adorned such that it represents the exterior building surface.

8. The decorative gift-wrap kit of claim 1 wherein the wrapping material comprises patterned paper adorned such that it represents the exterior building surface.

9. The decorative gift-wrap kit of claim 1 wherein the wrapping material comprises textured paper adorned such that it represents the exterior building surface.

10. The decorative gift-wrap kit of claim 1 further comprising a corresponding booklet describing the Nativity story wherein the adhesive stickers are removably adhered to pages of the booklet.

11. The decorative gift-wrap kit of claim 1 wherein the wrapping material comprises wrapping material visually resembling stone such that it represents the exterior building surface.

12. The decorative gift-wrap kit of claim 1 wherein the wrapping material comprises wrapping material visually resembling mud such that it represents the exterior building surface.

13. The decorative gift-wrap kit of claim 1 further comprising adhesive stickers visually representing at least one of people, animals, plant life, pottery, carts, and scenery items; and the Nativity set.

14. A method for creating a background scene of a skyline of a Bethlehem village from a plurality of presents for placing behind a separate Nativity set, such that the plurality of wrapped presents does not resemble presents, comprising:

(a) wrapping a plurality of presents with wrapping material in sheet form provided in one or more rolls or sheets to create a plurality of wrapped presents of different shapes and sizes such that the size and shape of the presents to be wrapped, rather than the size and shape of the wrapping material, govern the size and shape of the wrapped presents that ultimately are arranged as buildings of different shapes and sizes, wherein the wrapping material includes an adornment to visually represent the appearance of an exterior building material surface without any building features, wherein the plurality of wrapped presents of different shapes and sizes represent a plurality of different shaped and sized buildings;

(b) applying a plurality of adhesive stickers to the wrapped presents, said stickers having an adhesive side and an outer side, said outer side visually representing building features consisting of at least one of windows, doors, doorways, stairways, archways, and window openings so that the wrapped presents simulate a plurality of buildings; and (c) arranging the plurality of wrapped presents together behind the separate Nativity set to simulate a plurality of buildings, the size and shape of which is governed by the size and shape of the presents, as the background scene of the skyline of the Bethlehem village behind the separate Nativity set, wherein the Nativity set comprises a manger in a barn for the Christian re-enactment of the birth of Jesus, and wherein the plurality of wrapped presents resemble the skyline of the Bethlehem village and do not resemble Christmas presents that would detract from the separate Nativity set.

15. The method of claim 14 further comprising (i) one or more gift-bags, wherein the gift-bags are adorned with one or more of colors, patterns, or textures to visually represent exterior building surfaces for receiving presents in the gift-bags creating plurality of bagged presents, and (ii) one or more gift-boxes, wherein the gift-boxes are adorned with one or more of colors, patterns, or textures to visually represent exterior building surfaces for receiving presents in the gift-boxes creating a plurality of presents in gift-boxes, wherein the plurality of adhesive stickers are applied to the plurality of bagged presents and presents in gift-boxes and the plurality of bagged presents and presents in gift-boxes are arranged together with the plurality of wrapped presents in the background scene of the Nativity set.

16. The method of claim 14 further comprising the step of applying adhesive stickers visually representing at least one of people, animals, plant life, pottery, carts, and scenery items to the wrapped presents.

17. The method of claim 16 further comprising referring to a suggested display for the adhesive stickers prior to applying the plurality of adhesive stickers to the wrapped presents.

18. A method for wrapping presents to look like a background scene of a skyline of a Bethlehem village for placing behind a separate Nativity set by wrapping the presents to simulate a plurality of background buildings adapted to be arranged as a background scene of a skyline for the separate Nativity set, comprising:

(a) providing wrapping material in sheet form in one or more rolls or sheets, wherein the wrapping material includes an adornment to visually represent the appearance of an exterior building material surface without any building features for creating a plurality of wrapped presents of different shapes and sizes with the wrapping material, such that the size and shape of the presents to be wrapped, rather than the size and shape of the wrapping material, govern the size and shape of the wrapped presents that ultimately are arranged as buildings of different shapes and sizes, and arranging the plurality of wrapped presents of different shapes and sizes together as different shaped and sized buildings, based on the size and shape of the presents, to form a background scene of a skyline of a Bethlehem village for placing behind a Nativity set, wherein the Nativity set comprises a manger in a barn for the Christian re-enactment of the birth of Jesus;

(b) providing a plurality of adhesive stickers removably adhered to a backing sheet, said stickers having an adhesive side and an outer side, said outer side visually representing building features consisting of at least one of windows, doors, doorways, stairways, archways, and window openings and applying the adhesive stickers to the plurality of wrapped presents, such that the adhesive stickers realistically enhance the background scene of the skyline of the Bethlehem village for the Nativity set;

(c) providing a set of instructions with suggested arrangement displays thereon to direct a user to arrange the plurality of wrapped presents as the background scene of the skyline of the Bethlehem village for placement behind the Nativity set, so that the plurality of wrapped presents resemble the skyline of the Bethlehem village when placed behind the separate Nativity set and do not resemble Christmas presents that would detract from the separate Nativity set;

(d) providing a corresponding booklet describing the Nativity story wherein the adhesive stickers are adapted to be removably adhered to pages of the booklet as well as to the wrapped presents; and (e) providing the separate Nativity set comprising a manger in a barn for the Christian re-enactment of the birth of Jesus.

* * * * *